United States Patent [19]

Kozacka et al.

[11] 4,254,394

[45] Mar. 3, 1981

[54] ELECTRIC FUSE HAVING PLUG TERMINALS

[75] Inventors: Frederick J. Kozacka, South Hampton; Richard A. Belcher, Hampton Falls, both of N.H.

[73] Assignee: Gould Inc., Rolling Meadows, Ill.

[21] Appl. No.: 68,237

[22] Filed: Aug. 20, 1979

[51] Int. Cl.[3] ..... H01H 85/16

[52] U.S. Cl. ..... 337/231; 337/252

[58] Field of Search ..... 337/229, 231, 248, 251, 337/252, 254, 159

[56] References Cited

U.S. PATENT DOCUMENTS

| | | | |
|---|---|---|---|
| 3,486,155 | 12/1969 | McCaughna | 337/231 |
| 3,801,945 | 4/1974 | Howard | 337/159 |
| 3,849,754 | 11/1974 | Blewitt et al. | 337/231 |
| 3,967,228 | 6/1976 | Koch et al. | 337/248 |

*Primary Examiner*—George Harris
*Attorney, Agent, or Firm*—Erwin Salzer

[57] ABSTRACT

An electric fuse having plug terminals. The fusible elements are connected to the plug terminal by the intermediary of metal strips having three sections. One section is inserted into the grooves of the plug terminals and conductively connected with the latter. Another section is arranged in a plane parallel to, but spaced from, the plane defined by said first mentioned section. A third section of the metal strips conductively interconnects the first section and the second section thereof. The aforementioned strip, if of sufficient length, greatly increases the flexibility of the fusible-element-and-strip-unit, minimizes the voltage drop across the fuse if the strip is considerably thicker than that of the fusible element of the fuse, and permits an arrangement of the fusible elements within the casing of the fuse that does not depend on the arrangement of the grooves on the axially inner end surfaces of the plug terminals and allows the pulverulent arc-quenching filler to exert a maximal arc-quenching action.

17 Claims, 10 Drawing Figures

ELECTRIC FUSE HAVING PLUG TERMINALS

BACKGROUND OF THE INVENTION

This invention relates to electric fuses having terminal plugs inside the casing and closing the ends thereof. Plug type terminal fuses are distinguished from ferrule type terminal fuses by their large dimensional stability. Such fuses are disclosed, for instance, in U.S. Pat. No. 2,658,974; Nov. 10, 1953 to Frederick J. Kozacka for HIGH CURRENT CARRYING CAPACITY CURRENT LIMITING FUSES, and in many other patents.

One of the disadvantages of prior art plug terminal fuses consists in that the fusible elements thereof were easily distorted by bending or twisting forces.

Another of the disadvantages of prior art plug terminal fuses consists in that the positioning of the fusible elements thereof was determined by the positioning of the grooves in the axially inner end surfaces of the plug terminals. This made it difficult to position the fusible elements in the best way required for any particular application.

Another limitation of prior art plug terminal fuses resides in the relatively large cross-section and length of the blade contacts which are in excess of the cross-section and length required to reduce the voltage drop to a predetermined minimal value and thus constitute a waste of material, or an over design.

It is the principal object of the present invention to provide plug terminal fuses which are not subject to any of the above limitations.

SUMMARY OF THE INVENTION

Electric low-voltage fuses embodying the present invention include a tubular casing of electric insulating material; a pulverulent arc-quenching filler inside said casing; a pair of plug terminals arranged inside said casing and plugging the ends thereof; grooves in the axially inner end surfaces of said pair of plug terminals; and a fusible element inside said casing, embedded in said arc-quenching filler and forming a portion of a current path conductively interconnecting said pair of plug terminals.

The novel feature in fuses according to the present invention consists in that the ends of said fusible element are conductively connected to said pair of plug terminals by a pair of connectors formed by bent metal strips of which the axially inner ends are conductively connected to said fusible element, of which the axially outer ends are inserted into said grooves of said plug terminals and conductively connected to said pair of plug terminals. Said axially outer ends and said axially inner ends of each said metal strips are arranged in parallel, spaced planes, and each said metal strips further includes a transversely arranged intermediate portion conductively connecting said axially inner ends and said axially outer ends of each of said strips. The ends of said strips conductively connected to said plug terminals are preferably much longer than the transversely arranged portions thereof.

BRIEF DESCRIPTION OF THE DRAWINGS

FIG. 5 is a longitudinal section of the fuse shown in FIG. 4 taken along a plane at right angles to the plane along which FIG. 4 is taken;

DESCRIPTION OF PREFERRED EMBODIMENTS

Figure 1:
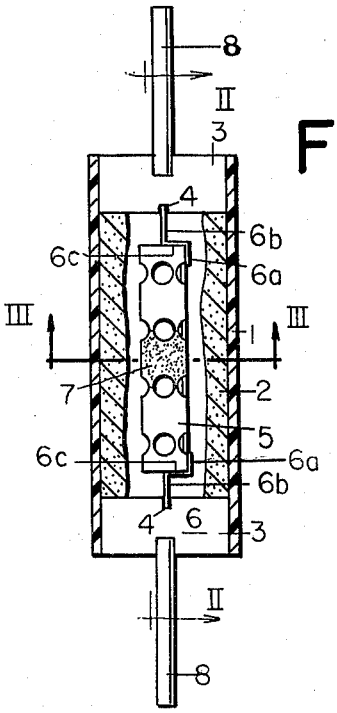
FIG. 1 is substantially a longitudinal section of a fuse embodying this invention having a channel-shaped fusible element whose web portion is situated to the right of FIG. 1.
Figure 2:
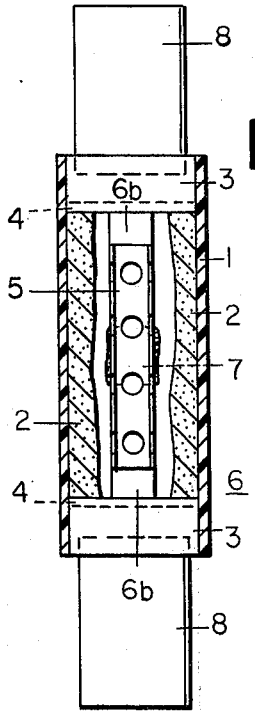
FIG. 2 is substantially a longitudinal section taken along II—II of FIG. 1.
Figure 3:
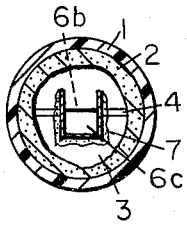
FIG. 3 shows the same structure as FIGS. 1 and 2 taken along III—III of FIG. 1.

Referring now to the drawings, and more particularly to FIGS. 1-3 thereof, reference character 1 has been applied to indicate a tubular casing of electric insulating material such as, e.g., a laminate of glass-cloth and a synthetic resin. Casing 1 is filled with a pulverulent arc-quenching filler 2 such as, for instance, quartz sand. A pair of plug terminals 3 is arranged inside of casing 1 and plugs the ends thereof. The axially inner end surfaces of plug terminals 3 are provided with a pair of grooves 4. Plug terminals 3 and casing 1 may be connected by fasteners, such as steel pins. This is well known in the art and shown, for instance, in U.S. Pat. No. 2,740,187; 04/03/56 to P. C. Jacobs, Jr. et al for METHODS OF ASSEMBLING FUSES. Fusible element 5 is arranged inside of casing 1 and submersed in arc-quenching filler 2. Fusible element 5 and terminals 3 are conductively connected by connectors or metal strips generally indicated by reference numeral 6. Each of connectors 6 is formed by a metal strip that is bent at 90 degrees. The axially inner ends **6*a* of metal strip 6 are conductively connected to fusible element 5. In the embodiment shown, fusible element 5 has multiple perforations and is channel-shaped. It may, however, take other shapes, e.g. it may be planar, or L-shaped. The axially outer ends 6*b* of connector-forming metal strips 6 are inserted into grooves 4 of plugs 3, and conductively connected to plugs 3. This may be effected by solder joints (not shown). The axially outer ends 6*b* and the axially inner ends 6*a* of each metal strip 6 are arranged in parallel spaced planes which makes it possible to arrange fusible elements in a pattern other than that defined by grooves 4, as shown more specifically in FIGS. 4-10. Metal strips 6 further include intermediate portions 6*c* arranged transversely to the portions 6*a* and 6*b* and conductively interconnecting portions 6*a* and 6*b*. The fusible element proper is perforated and may be provided with an M-effect causing overlay 7 of a metal having a lower fusing point than the base metal, e.g. silver or copper, which supports the overlay metal. Fusion of the overlay metal initiates a metallurgical reaction, or diffusion, which results in severing of fusible element 5 and of the current-path through the fuse. If desired, each plug terminal 3 may be provided with a groove at the axially outer end surfaces thereof for receiving a blade contact 8. The axially inner ends of blade contacts 8 may be inserted into said grooves and affixed to terminal plugs 3** by hard solder joints.

The fusible element 5 is of relatively thin, low resistivity metal, and said metal strips are of a relatively thick metal having a relatively low resistivity. This allows with a fuse closed by a pair of plug terminals to achieve all the advantages of a fuse with cap terminals or ferrules as disclosed in the co-pending patent application of Robert J. Panaro; 08/30/79, Ser. No. 073,079 for ELECTRIC FUSE HAVING COMPOSITE FUSIBLE ELEMENT. Fusible element 5 may be made of relatively thin sheet silver and metal strips 6 may be made of relatively thick copper having a thickness in the order of at least twice but less than five times the thickness of the fusible element 5. This means that strips 6 must have a much lower resistance than the fusible element 5, or that the lower resistivity of silver per unit of length greatly increased by the perforation therein is by far overcompensated by the higher thickness of the copper strip 6. In other words, the resistance of fusible element 5 exceeds the resistance of both metal strips 6.

It is also possible to make both the fusible element 5 and strip 6 of the same metal, particularly copper. In that instance the fusible element 5 is of relatively thin sheet copper, or of a small resistivity alloy thereof, and metal strips 6 are of relatively thick copper having a thickness of twice, or more than twice, but less than five times the thickness of fusible element 5. The reasons for these critical values are more fully explained in the above patent application of R. J. Panaro. The thickness of metal strips 6 must be at least in the order of two times the thickness of fusible element 5 to minimize the voltage drop across the fuse, and hence the energy consumed by the fuse. The thickness of metal strips 6 must be less than five times that of the fusible element 5 because the reduction in voltage drop beyond that level is not worth the additional amount of copper for strips 6 needed to achieve it. In other words, it is a matter of decreasing return.

The perforated fusible element 5 does not necessarily have to be channel-shaped. It may, for instance, be planar. This allows a relatively high heat transfer from perforated fusible element 5 into the surrounding arc-quenching filler 2, and a relatively small increase of the thickness of strips 6 relative to that of fusible element 5, e.g. a thickness ratio of about 2:1. On the other hand a channel-shaped configuration of the fusible element may require a higher thickness ratio such as, e.g., a thickness ratio of 4.5:1.

Figure 4:
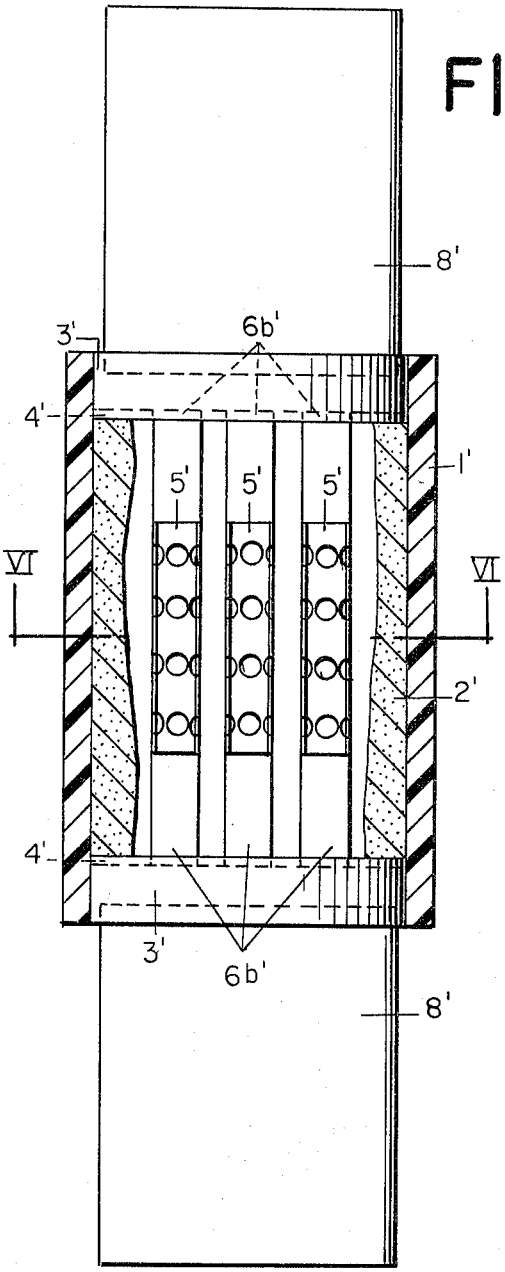
FIG. 4 is substantially a longitudinal section of a fuse embodying the present invention, but having a higher current-carrying capacity than the fuse shown in FIGS. 1—3.
Figure 5:
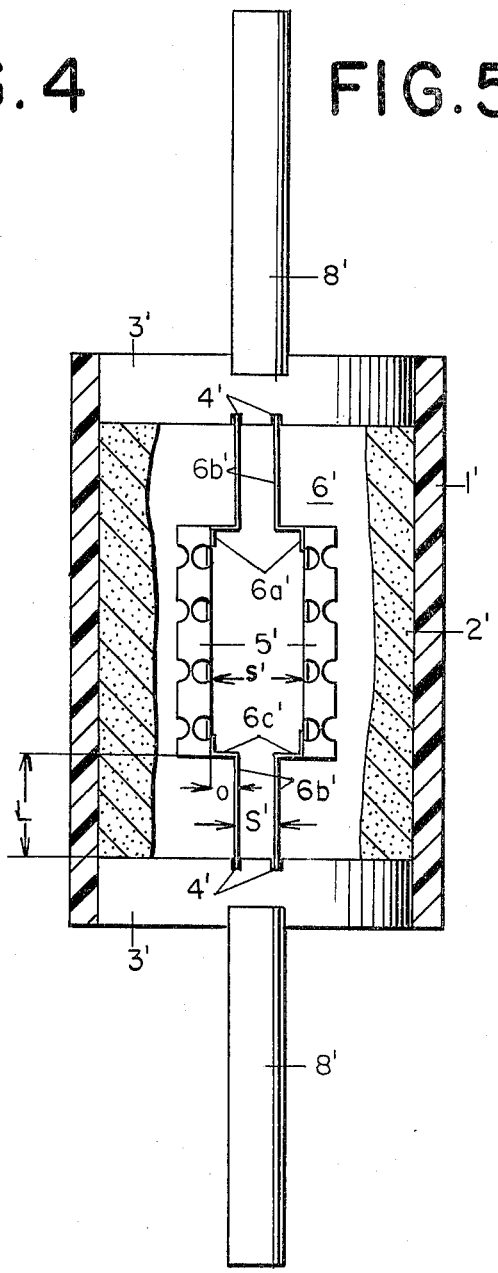
Figure 6:
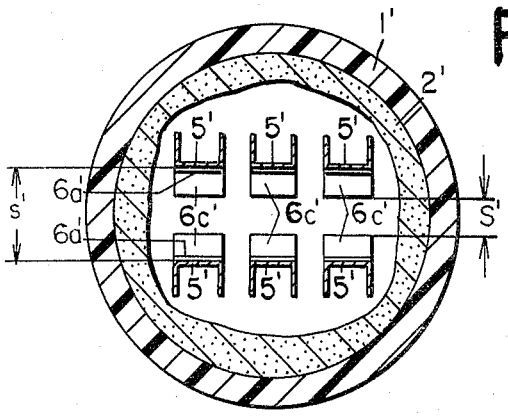
FIG. 6 is a section along VI—VI of FIG. 5.
Figure 7:
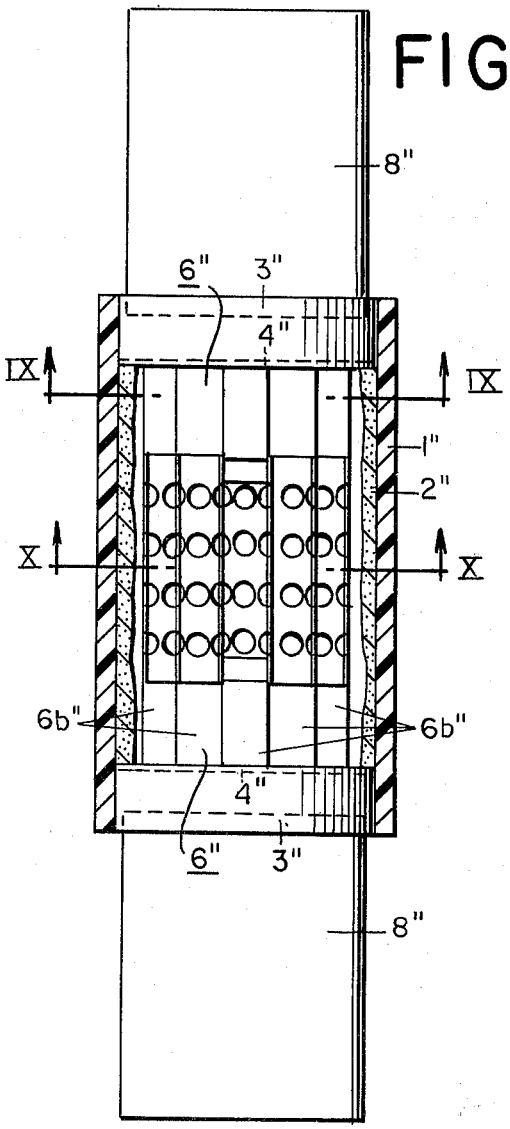
FIG. 7 is a longitudinal section of a multifuse element fuse wherein each of the fusible elements are arranged to cooperate with a large amount of arc-quenching filler.
Figure 8:
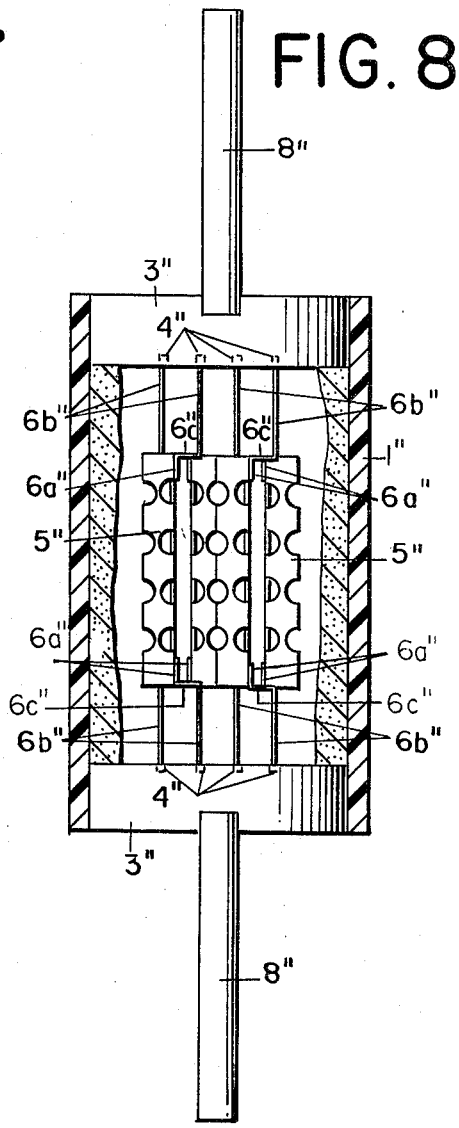
FIG. 8 is a longitudinal section of the fuse shown in FIG. 7 sectioned by a plane at right angles to the plane that sectioned FIG. 7.
Figure 9:
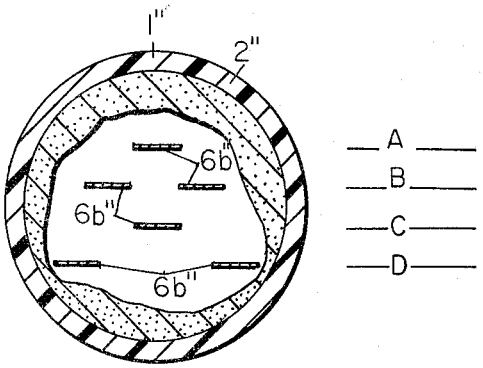
FIG. 9 is a section along IX—IX of FIG. 7.

Referring now to FIGS. 4 to 6, in these figures an M-effect overlay on the fusible elements 5' has been deleted, but such an overlay may be applied where necessary, or desirable, e.g. to limit the maximal rise in temperature of fusible elements 5'.

For reasons of greater clarity the fastener means tying together plug terminals 3' and casing 1' have likewise been deleted.

Like parts as in FIGS. 1–3 have been designated in FIGS. 4–6 by the same reference characters with a prime added, and have been designated in FIGS. 7–10 by the same reference characters with two primes added.

Referring now more specifically to FIGS. 4–6, numeral 1' has been applied to indicate a tubular casing of electric insulating material filled with a pulverulent arc-quenching filler 2' and plugged by a pair of terminal plugs 3' inside of casing 1'. Grooves 4' in the axially inner end surfaces of plug terminals 3' receive the axially outer ends of metal strips 6' which may be connected to grooves 4' of plug terminals by soft solder joints. The fusible element proper 5' may be either of silver or of copper, or of a low resistivity alloy thereof. The portions of casing 1' not occupied by other parts are filled with an arc-quenching filler 2', preferably quartz sand. The fusible elements 5' are arranged in two parallel planes having a given spacing 5'. The spacing of the grooves 4' is much smaller than that of fusible elements 5'. If, as in the instant case, the fusible elements are channel-shaped, the spacing 5' is the spacing between their web portions. If the fusible elements 5' are planar, their spacing is the shortest distance between the planes thereof. Blade contacts 8' may project from plug terminals 3' as in the embodiment of the invention shown in FIGS. 1-3. The planes defined by grooves 4', and the planes defined by fusible elements 5', or the web portions thereof, are all parallel, but $s' > S'$. Furthermore, the length L of arms **6*b'* by far exceeds the length o of arms 6*c'*. These proportions result in a great flexibility of units 5' and 6', and in a favorable spacing of fusible elements 5' which, in turn, results in an efficient use of the heat absorbing capacity of arc-quenching filler, or quartz-sand 2'**.

The perforated channel-shaped center portions or fusible element portions 5' may be of silver, and each of the non-perforated end portions 6' may be of copper having a thickness of more than twice, e.g. 4.5 times, the thickness of the perforated center portions 5'. As an alternative, the perforated center portions 5' and the non-perforated strips, or ends 6', may be both of copper, or a relatively low resistivity alloy thereof, the thickness of the latter being e.g. about 4.5 times that of the former.

Referring now to FIGS. 7–10, casing 1'' is filled with a pulverulent arc-quenching filler 2'' and plugged by plug terminals 3''. It houses six fusible elements 5'' which are arranged in such a way as to maximize the amount of arc-quenching filler 2'' active in solidifying the gases resulting from vaporization of fusible elements 5''. The fusible elements 5'' are provided with strips **6*a''*, 6*b''*, 6*c''* of which sections 6*b''* project into grooves 4'' in plugs 3'', sections 6*a''* are conductively connected to fusible elements 5'' and are arranged in spaced parallel relations from sections 6*b''*, and sections 6*a''* are arranged at right angles to sections 6*b''* and 6*c''*. There are but four grooves 4'' in terminal plugs 3'', each of which is arranged in one of four parallel planes A,B,C,D. Yet the spacing of the planes of fusible elements 5'' from that of sections 6*b''* allows a favorable configuration of fusible elements 5'' in regard to casing 1'', in addition to increasing the flexibility of units 5'', 6*b''*, 6*c''*, 6*a''*** and in addition to reducing the voltage drop across the fuse.

Figure 10:
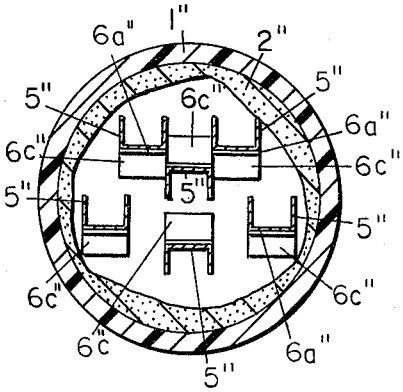
FIG. 10 is a section along X—X of FIG. 7.

In the structure shown in FIGS. 7–10 there are two channel-shaped fusible elements 5'' whose axially outer strips **6*b''* are located in plane D and whose flange portions are directed upwardly (as seen in FIG. 10). There is one channel-shaped fusible element 5'' whose axially outer strips 6*b''* are located in plane C and whose flange portions are directed downwardly (as seen in FIG. 10). There are two channel-shaped fusible elements 5'' whose strip portions 6*b''* are located in plane B and whose flange portions are directed upwardly (as seen in FIG. 10). And there is one channel-shaped fusible element 5'' whose strip portions 6*b''* are located in plane A and whose flange portions are directed downwardly (as seen in FIG. 10**).

Such a geometry provides a large interface between the fusible elements 5'' and the arc-quenching filler 2'' into which the gases resulting from vaporization of fusible elements 5'' escape. The spacing of the fusible elements 5'' of FIGS. 7–10 has proven desirable, though the upper and the lower portions of FIG. 10 are not symmetrical.

It will be observed that all the grooves in all the embodiments of the invention are parallel. Hence the grooves 4,4' and 4'' in each plug terminal can be produced by a single operation of a gang of cutters.

In the structure of FIGS. 7–10 there is a pair of grooves 4'' in each the opposite axially end surfaces of terminal plugs 3''. Said pair of grooves 4'' is situated at opposite sides of a plane at 90 degrees to said end surfaces. A plurality of fusible elements 5'' is arranged to different sides of, and in spaced relation from, said common plane. Said plurality of fusible elements is connected by a plurality of metal strips 6'' to the grooves 4'' in plug terminals 3''. Said metal strips 6'' have axially outer ends **6*b*'' engaging said pair of grooves 4'' and conductively connected to said pair of plug terminals 3''. Said metal strips 6'' have axially inner ends 6*a*'' conductively connected to the axially outer ends of said plurality of fusible elements 5'', and said metal strips have intermediate portions 6*c*'' angularly related to and conductively interconnecting said outer ends 6*b*'' and said inner ends 6*a*'' of said plurality of metal strips. Some of said intermediate portions 6*c*'' are arranged to one side and others of said intermediate portions 6*c*''** are arranged to the other side of the aforementioned plane.

To maximize flexibility the length relation between the strip portions **6*b*'' and 6*c*'' of the structure of FIGS. 7–10 ought to be the same as in the structure of FIGS. 4–6**.

The ratio of thickness between strips and fusible elements set forth in connection with FIGS. 4–6 applies also to the embodiment of the invention shown in FIGS. 7–10.

The term low fusing $i^2 \cdot t$ metal is applied to encompass both silver, copper and alloys thereof that have substantially the same conductivity as silver and copper.

We claim as our invention:

1. An electric low-voltage fuse comprising (a) a tubular casing of electric insulating material;

(b) a pulverulent arc-quenching filler inside said casing;

(c) a pair of plug terminals arranged inside said casing and plugging the ends thereof;

(d) grooves in the axially inner end surfaces of said pair of plug terminals; and (e) a perforated fusible element inside said casing, embedded in said arc-quenching filler and forming a portion of a current path conductively interconnecting said pair of plug terminals, wherein the novel feature consists in that (f) the ends of said fusible element are conductively connected to said pair of plug terminals by a pair of intermediate connectors each formed by a bent metal strip of which the axially inner end is conductively connected to said fusible element, of which the axially outer end is inserted into said grooves of and conductively connected with said pair of plug terminals and arranged in planes parallel to, and spaced from, the planes defined by said axially inner end, and each said metal strip further including a transversely arranged intermediate portion conductively connecting said axially inner end and said axially outer end thereof.

2. An electric fuse as specified in claim 1 wherein said perforated fusible element is of a relatively thin low resistivity metal, and said metal strips are of a relatively thicker metal having a relatively higher resistivity.

3. An electric fuse as specified in claim 2 wherein said perforated fusible element is of relatively thin sheet silver and said metal strips are of relatively thick copper having at least a thickness in the order of twice the thickness of said fusible element.

4. An electric fuse as specified in claim 2 wherein said perforated fusible element is of relatively thin sheet copper or of a small resistivity alloy thereof, and said metal strips are of relatively thick copper having a thickness of more than twice and less than five times the thickness of said fusible element.

5. An electric low voltage fuse comprising (a) a tubular casing of electric insulating material;

(b) a pulverulent arc-quenching filler inside said casing;

(c) a pair of plug terminals inside said casing plugging the ends of said casing;

(d) parallel groove means at the axially inner end surfaces of said pair of plug terminals; and (e) electroconductive means interconnecting said pair of plug terminals; wherein the novel features consist in that (f) said electroconductive means include a perforated fusible element portion and a pair of non-perforated end portions;

(g) said fusible element portion being of a relatively thin low resistivity sheet metal;

(h) each of said pair of end portions of a relatively thick sheet metal having a relatively higher resistivity than said fusible element portion;

(i) said pair of end portions being each in the shape of a metal strip including a first section arranged in a first plane and inserted with one end thereof into said groove means in one of said pair of plug terminals and conductively connected to said one of said pair of plug terminals, a second section arranged in a second plane spaced from said first plane and parallel thereto and conductively connected with one end thereof to said fusible element portion, and an intermediate section substantially at right angles to said first section and to said second section and conductively interconnecting said first section and said second section.

6. An electric low-voltage fuse as specified in claim 5 wherein said fusible element portion is of silver and each of said non-perforated end portions is of copper, each of said end portions having a thickness that is more than twice the thickness of said fusible element portion.

7. An electric fuse as specified in claim 5 wherein said fusible element portion and said non-perforated end portions are of copper, or of a relatively low resistivity alloy thereof, and the thickness of the latter is at least two times the thickness of the former.

8. An electric low-voltage fuse as specified in claim 5 including a plurality of electroconductive means interconnecting said pair of plug terminals, each of said electroconductive means including a perforated fusible element portion and a pair of non-perforated end portions wherein (a) said perforated fusible element portion of each of said plurality of electroconductive means is arranged selectively in one of two first parallel planes having a relatively large spacing from each other;

(b) said first section of each said pair of end portions is arranged in a second pair of parallel planes having a smaller spacing from each other than said first parallel planes;

(c) said second section of each said pair of end portions being arranged substantially in said first parallel planes; and (d) said intermediate section of each of said pair of end portions being arranged in one of two parallel planes at substantially right angles to said two first parallel planes.

9. an electric fuse as specified in claim 5 including a plurality of current paths each comprising a perforated fusible element portion and a pair of non-perforated end portions conductively connected to the ends of each of said fusible element portions wherein (a) said fusible element portion of each said plurality of current paths is channel-shaped and the web portion thereof arranged in either one of two parallel planes having a predetermined spacing from each other;

(b) the flange portions thereof project in opposite directions from some of said web portions;

(c) said parallel groove means having a spacing less than said predetermined spacing of said web portions; and (d) the length of said first section of said metal strip is a plural of the length of said second section thereof.

10. An electric fuse as specified in claim 5 including a plurality of electroconductive means interconnecting said pair of plug terminals, each of said electroconductive means including a perforated channel-shaped fusible element portion and a pair of end portions projecting in opposite direction from said fusible element portions wherein (a) the webs of some of said center portions are arranged in a first plane;

(b) the webs of other of said center portions are arranged in a second plane parallel to and having a relatively large spacing from said first plane;

(c) the flanges of said first mentioned webs projecting in one direction from said first mentioned webs;

(d) the flange portions of said second mentioned webs projecting in opposite direction from said one direction from said second mentioned webs;

(e) said first section of each said pair of end portions being arranged in parallel planes having a relatively smaller spacing from each other than the spacing between said first plane and said second plane;

(f) said second sections of each said pair of end portions being arranged in said first and second plane; and (g) the intermediate section of each of said pair of end portions being arranged in one of two parallel planes substantially at right angles to said first plane and to said second plane.

11. An electric fuse as specified in claim 5 including a plurality of electroconductive means interconnecting said pair of plug terminals wherein (a) said fusible element portions include planar portions;

(b) some of said fusible element portions forming a first group being arranged with said planar portions thereof in a common first plane;

(c) others of said fusible element portions forming a second group being arranged with the said planar portions thereof in a common second plane;

(d) said second plane being parallel to said first plane and having a predetermined spacing from said first plane;

(e) said fusible element portions forming said first group having metal strips whose first sections are substantially longer than their second sections and are arranged in a common third plane parallel to said common first plane;

(f) said fusible element portions forming said second group having metal strips whose first sections are substantially longer than their second sections and are arranged in a common fourth plane parallel to said second common second plane;

(g) said third and said fourth plane having a smaller spacing than said first and second plane.

12. An electric low-voltage fuse comprising (a) a tubular casing of electric insulating material;

(b) a pulverulent arc-quenching filler inside said casing;

(c) a pair of plug terminals inserted into the ends of said casing and plugging said ends;

(d) a pair of parallel grooves in opposite axially inner end surfaces of said pair of plug terminals, said pair of grooves being situated in a common plane at 90 degrees to said end surfaces; and (e) a plurality of current paths conductively interconnecting said pair of grooves and including a plurality of fusible elements wherein the novel features consist in that (f) said plurality of fusible elements are arranged to different sides of and in spaced relation from said common plane;

(g) said plurality of fusible elements are conductively connected by a plurality of metal strips to said pair of plug terminals, said plurality of metal strips having axially outer ends situated in said common plane, engaging said pair of grooves and conductively connected to said pair of plug terminals; said plurality of metal strips also having axially inner ends conductively connected to the axially outer ends of said plurality of fusible elements, and said plurality of metal strips further having intermediate portions angularly related to, and conductively interconnecting, said outer ends and said inner ends thereof, some of said intermediate portions being arranged to one side and others of said intermediate portions being arranged to the other side of said common plane.

13. An electric fuse as specified in claim 12 wherein the length of said axially outer ends is a multiple of the length of said intermediate portions.

14. An electric fuse as specified in claim 12 wherein said plurality of fusible elements and said plurality of metal strips are of different low resistivity metals, and the thickness of each of said plurality of strips is at least about twice and less than five times the thickness of each of said plurality of fusible elements.

15. An electric fuse as specified in claim 12 wherein each of said plurality of fusible elements is channel-shaped.

16. An electric low-voltage fuse comprising (a) tubular casing of electric insulating material;

(b) a pulverulent arc-quenching filler inside said casing;

(c) a pair of plug terminals inside said casing plugging the ends of said casing;

(d) a plurality of parallel grooves in the axially inner end surfaces of said pair of plug terminals defining a plurality of parallel planes; and (e) a plurality of electroconductive means interconnecting said plurality of grooves wherein the novel features consist in that (f) each of said electroconductive means includes a perforated relatively thin fusible element portion of a relatively low fusing $i^2 \cdot t$ metal, and a pair of non-perforated relatively thick metal strips being bent twice at 90 degrees and each interconnecting one of the ends of said fusible element portion and one said plurality of grooves in one said pair of plug terminals.

17. An electric fuse as specified in claim 16 wherein the length of the ends of said strips immediately adjacent said plurality of grooves in said pair of plug terminals by far exceeds the length of the portions of said strips at right angles to said first mentioned ends thereof.

* * * * *